US008998641B2

(12) United States Patent
Kanda

(10) Patent No.: US 8,998,641 B2
(45) Date of Patent: Apr. 7, 2015

(54) TERMINAL STRUCTURE OF ELECTRICAL CABLE, SHIELDED CONNECTOR AND TERMINAL TREATMENT METHOD OF ELECTRICAL CABLE

(71) Applicant: Yazaki Corporation, Tokyo (JP)

(72) Inventor: Hidenori Kanda, Makinohara (JP)

(73) Assignee: Yazaki Corporation, Tokyo (JP)

( * ) Notice: Subject to any disclaimer, the term of this patent is extended or adjusted under 35 U.S.C. 154(b) by 146 days.

(21) Appl. No.: 13/921,339

(22) Filed: Jun. 19, 2013

(65) Prior Publication Data

US 2013/0344738 A1 Dec. 26, 2013

(30) Foreign Application Priority Data

Jun. 20, 2012 (JP) ..... 2012-139020

(51) Int. Cl.
*H01R 9/05* (2006.01)
*H01R 13/6592* (2011.01)
*H01R 4/18* (2006.01)

(52) U.S. Cl.
CPC ..... *H01R 13/6592* (2013.01); *H01R 4/185* (2013.01); *H01R 9/0518* (2013.01)

(58) Field of Classification Search
USPC ..... 439/585, 877, 878, 607.5
See application file for complete search history.

(56) References Cited

U.S. PATENT DOCUMENTS

| | | | | |
|---|---|---|---|---|
| 5,110,308 | A * | 5/1992 | Nishikawa et al. | 439/582 |
| 7,140,914 | B2 * | 11/2006 | Kojima | 439/585 |
| 8,079,870 | B2 * | 12/2011 | Nakamura et al. | 439/585 |
| 2013/0344737 | A1 * | 12/2013 | Kanda | 439/607.5 |

FOREIGN PATENT DOCUMENTS

| | | | |
|---|---|---|---|
| JP | 2006-0310135 | A | 11/2006 |
| JP | 2011-034773 | A | 2/2011 |

* cited by examiner

*Primary Examiner* — Xuong Chung Trans
(74) *Attorney, Agent, or Firm* — Sughrue Mion, PLLC

(57) ABSTRACT

A terminal structure includes an electrical cable that includes an inner conductor, an insulator provided around the inner conductor, a shield layer made of a metal foil around the insulator, and a sheath layer made of a resin tape around the shield layer, a shielded connector that is connected to a terminal of the electrical cable. The shielded connector includes an inner terminal connected to the inner conductor, an insulating member covering the inner terminal, an outer terminal covering the insulating member, and a pressing member for pressing the outer terminal against the shield layer. The outer terminal includes connecting pieces disposed along an outer circumference of the insulator. The pressing member is crimped around the shield layer so that the connecting pieces are pressed against and connected to the shield layer.

3 Claims, 8 Drawing Sheets

TERMINAL STRUCTURE OF ELECTRICAL CABLE, SHIELDED CONNECTOR AND TERMINAL TREATMENT METHOD OF ELECTRICAL CABLE

CROSS REFERENCE TO RELATED APPLICATION

This application is based on Japanese Patent Applications No. 2012-139020 filed on Jun. 20, 2012, the contents of which are incorporated herein by reference.

BACKGROUND OF THE INVENTION

1. Technical Field

The present invention relates to a terminal structure of an electrical cable, a shielded connector and a terminal treatment method of the electrical cable.

2. Background Art

As shown in FIG. 5, a shielded connector 111 adapted to be connected to a shielded electrical cable 105, in which a shield conductor 103 is covered around a signal conductor 101 with an insulator 102 interposed therebetween and a sheath 104 is covered around an outer circumference of the shield conductor 103, is known (see JP-A-2006-310135 and JP-A-2011-034773). In the shielded connector 111, an inner conductor terminal 112 is connected to a terminal of the signal conductor 101, the inner conductor terminal 112 is received in a generally cylindrical-shaped tubular receiving portion 115 of an outer conductor terminal 114 with a dielectric 113 interposed therebetween, and also the outer conductor terminal 114 is connected to the shield conductor 103 of the shield electrical cable 105.

To connect the shielded connector 111 to the shielded electrical cable 105, the signal conductor 101, the insulator 102 and the shield conductor 103 are firstly exposed in this order as shown FIG. 6A. Then, the inner conductor terminal 112 is connected to the signal conductor 101 as shown in FIG. 6B, and the inner conductor terminal 112 is inserted in the dielectric 113 so that the outer conductor terminal 114 is disposed on a terminal of the shielded electrical cable 105 as shown in FIG. 6C. Subsequently, as shown in FIG. 6D, a shield pressing part 114*a* and a cable pressing part 114*b* of the outer conductor terminal 114 are pressed by crimping.

The shield conductor 103 of the shielded electrical cable 105 as described above is essential because the shield conductor 103 has important functions of impedance matching, shielding against a noise, or electrical/mechanical connection to the outer conductor terminal 114.

However, the shield conductor 103 is made of a braid woven by conductive wires, and thus, for production thereof, a dedicated equipment is required and also a significant time is taken, thereby causing an increase in cost.

Accordingly, the present invention has been made keeping in mind the above problem, and an object of the invention is to provide a terminal structure of a low-cost electrical cable having a shield effect, a shielded connector adapted to be connected to the electrical cable, and a terminal treatment method of the electrical cable.

SUMMARY OF THE INVENTION

To achieve the above object, a terminal structure of an electrical cable according to the present invention is characterized by the following (1).

(1) A terminal structure includes an electrical cable that includes an inner conductor, an insulator provided around the inner conductor, a shield layer made of a metal foil around the insulator, and a sheath layer made of a resin tape around the shield layer, a shielded connector that is connected to a terminal of the electrical cable. The shielded connector includes an inner terminal connected to the inner conductor, an insulating member covering the inner terminal, an outer terminal covering the insulating member, and a pressing member for pressing the outer terminal against the shield layer. The outer terminal includes connecting pieces disposed along an outer circumference of the insulator. The pressing member is crimped around the shield layer so that the connecting pieces are pressed against and connected to the shield layer.

According to the terminal structure of the electrical cable of the configuration of the above (1), the connecting pieces of the outer terminal of the shielded connector are pressed against and connected to the shield layer, which is made of a metal foil wound around the insulator, by means of the pressing member. Accordingly, the terminal structure having a good shield effect can be obtained.

In addition, the shield layer formed by winding an inexpensive metal foil without using a braid woven by conductive wires is included, thereby achieving a significant cost reduction.

Also, to achieve the above object, a shielded connector according to the present invention is characterized by the following (2).

(2) A shielded connector adapted to be connected to a terminal of the electrical cable including an inner conductor, an insulator around the inner conductor, a shield layer made of a metal foil around the insulator, and a sheath layer made of a resin tape around the insulator, the shielded connector includes an inner terminal that is connected to the inner conductor, an insulating member that covers the inner terminal, an outer terminal that covers the insulating member, and a pressing member that presses the outer terminal against the shield layer. The outer terminal includes connecting pieces disposed along an outer circumference of the insulator. The pressing member is crimped around the shield layer so that the connecting pieces are pressed against and connected to the shield layer.

According to the shielded connector of the configuration of the above (2), the connecting pieces of the outer terminal are pressed against and connected to the shield layer, which is made of a metal foil wound around the insulator, by means of the pressing member. Accordingly, when being connected to the electrical cable, a good shield effect can be obtained.

In addition, after the connecting pieces of the outer terminal are disposed along the outer circumference of the insulator, the shield layer made of a metal foil is wound around the insulator and then the pressing member is crimped. As a result, the outer terminal can be very easily connected to the shield layer in a conductive state.

In other words, the shielded connector can be very easily connected to the electrical cable in which the shield layer formed by winding an inexpensive metal foil without using a braid woven by conductive wires is included, thereby achieving a significant cost reduction.

Further, to achieve the above object, a terminal treatment method of an electrical cable according to the present invention is characterized by the following (3).

(3) A terminal treatment method of an electrical cable for mounting a shielded connector to a terminal of an electrical cable, the electrical cable including an inner conductor, an insulator around the inner conductor, a shield layer made of a metal foil around the insulator, and a sheath layer made of a resin tape around the insulator, the shielded connector includes an inner terminal, an insulating member covering the inner terminal, and an outer terminal covering the insulating member. The terminal treatment method includes:

exposing the inner conductor from the insulator;

connecting the inner terminal to the exposed inner conductor;

mounting the outer terminal, which has the insulating member, on the inner terminal so that connecting pieces formed on the outer terminal are disposed along an outer circumference of the insulator;

providing a shield layer by winding a metal foil around the insulator;

pressing the connecting pieces against the shield layer to be connected with each other, by crimping the pressing member onto an outer circumference of the shield layer at a position where the connecting pieces are disposed; and providing the sheath layer by winding a resin tape around the shield layer.

According to the terminal treatment method of the electrical cable of the configuration of the above (3), the connecting pieces of the outer terminal of the shielded connector are pressed against and connected to the shield layer, which is made of a metal foil wound around the insulator, by means of the pressing member. Accordingly, the terminal treatment can be easily performed to have a good shield effect.

Also, the shield layer is formed by winding an inexpensive metal foil without using a braid woven by conductive wires, thereby achieving a significant cost reduction.

According to the present invention, a terminal structure of a low-cost electrical cable having a shield effect, a shielded connector adapted to be connected to the electrical cable, and a terminal treatment method of the electrical cable can be provided.

In the foregoing, the present invention has been briefly described. Also, details of the present invention will be further apparent, when modes (hereinafter, referred to as "embodiments") for embodying the invention as described below are thoroughly read with reference to the accompanying drawings.

DESCRIPTION OF EMBODIMENTS

Examples of embodiments of the present invention will be now described with reference to the accompanying drawings.

Figure 1:
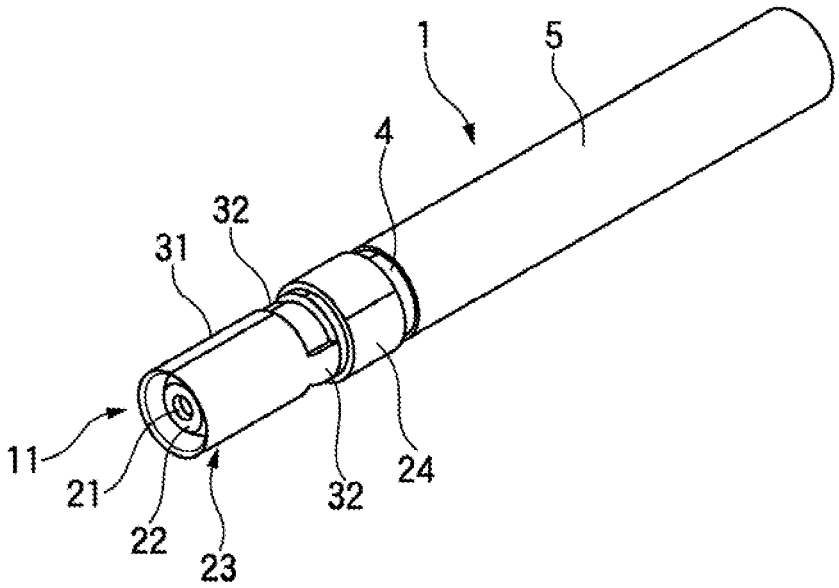
FIG. 1 is a perspective view of a terminal portion showing a terminal structure of an electrical cable and a shielded connector according to the present embodiment.
Figure 2:
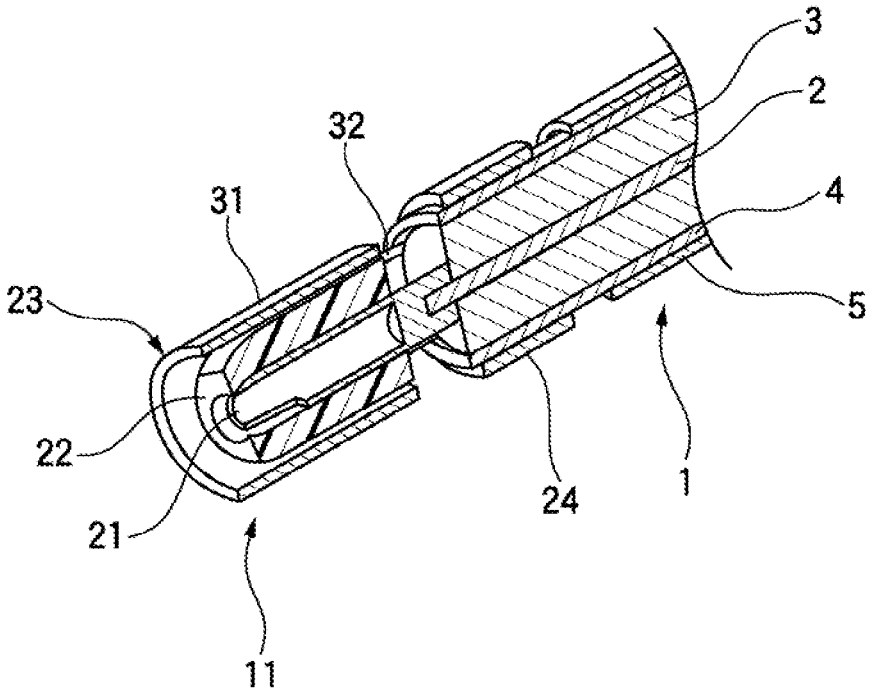
FIG. 2 is a perspective sectional view of the terminal portion showing the terminal structure of the electrical cable and the shielded connector according to the embodiment.
Figure 3:
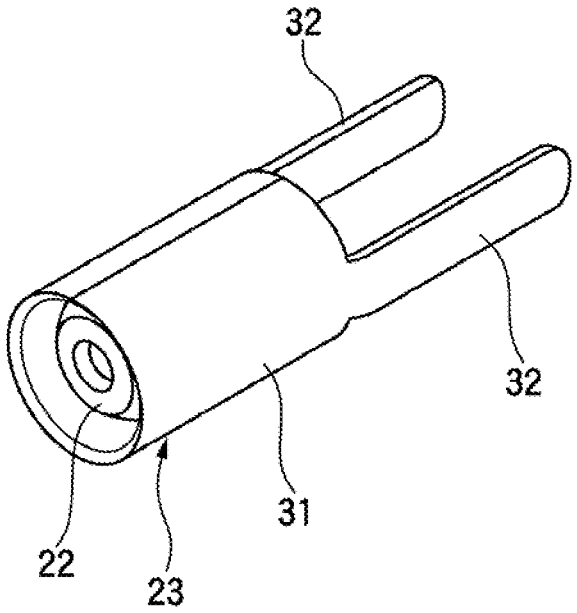
FIG. 3 is a perspective view showing an outer terminal of the shielded connector according to the embodiment adapted to be connected to a terminal of the electrical cable.

FIG. 1 is a perspective view of a terminal portion showing a terminal structure of an electrical cable and a shielded connector according to the present embodiment, FIG. 2 is a perspective sectional view of the terminal portion showing the terminal structure of the electrical cable and the shielded connector according to the embodiment, and FIG. 3 is a perspective view showing an outer terminal of the shielded connector according to the embodiment adapted to be connected to a terminal of the electrical cable.

As shown in FIGS. 1 and 2, a terminal structure according to the present embodiment is applied to a terminal portion of an electrical cable 1 adapted to be provided with a shielded connector 11. The electrical cable 1 includes an inner conductor 2 and an insulator 3 formed of an insulating material around the inner conductor 2. The electrical cable 1 is provided with a shield layer 4 formed of a metal foil around the insulator 3 and is additionally provided with a sheath layer 5 formed of a resin tape around an outer circumference of the shield layer 4.

In the electrical cable 1, the inner conductor 2 is exposed at a terminal portion thereof connected to the shielded connector 11.

The shielded connector 11 according to the present embodiment connected to the terminal of the electrical cable 1 includes an inner terminal 21, an insulating member 22, an outer terminal 23, and a pressing member 24.

The inner terminal 21 is formed of a conductive metal plate and is connected to the inner conductor 2. The insulating member 22 is formed of an insulating material, such as a resin, and is inserted outside of the inner conductor 2. The outer terminal 23 is formed of a conductive metal plate and is connected to the shield layer 4.

As shown in FIG. 3, the outer terminal 23 includes a shield portion 31 and a pair of connecting pieces 32. The shield portion 31 is formed in a cylindrical shape, and the insulating member 22 inserted outside of the inner terminal 21 is received in the shield portion 31. The connecting pieces 32 are extended from both sides of the shield portion 31 in a direction opposite to the terminal of the electrical cable 1 and are disposed on an outer circumference of the insulator 3 of the electrical cable 1.

The pressing member 24, which is formed of a conductive metal plate, is disposed on an outer circumference of the shield layer 4 in the terminal of the electrical cable 1, and then is pressed and fixed thereon by crimping. Also, by crimping the pressing member 24, an end portion of the shield layer 4 is connected to the connecting pieces 32 of the outer terminal 23, and as a result, the outer terminal 23 is electrically connected to the shield layer 4.

According to the terminal structure of the electrical cable of the foregoing embodiment, the connecting pieces 32 of the outer terminal 23 of the shielded connector 11 are pressed against and connected to the shield layer 4, which is made of a metal foil wound around the insulator 3, by means of the pressing member 24. Accordingly, the terminal structure having a good shield effect can be obtained.

In addition, the shield layer 4 formed by winding an inexpensive metal foil without using a braid woven by conductive wires is included, thereby achieving a significant cost reduction.

Further, according to the shielded connector 11 of the present embodiment used for the terminal structure as described above, the connecting pieces 32 of the outer terminal 23 are pressed against and connected to the shield layer 4, which is made of a metal foil wound around the insulator 3, by means of the pressing member 24. Accordingly, when being connected to the electrical cable 1, a good shield effect can be obtained.

Also, after the connecting pieces 32 of the outer terminal 23 are disposed along the outer circumference of the insulator 3, the shield layer 4 made of a metal foil is wound around the insulator 3 and then the pressing member 24 is crimped. As a result, the outer terminal 23 can be very easily connected to the shield layer 4 in a conductive state.

In other words, the shielded connector 11 can be very easily connected to the electrical cable 1 in which the shield layer 4 formed by winding an inexpensive metal foil without using a braid woven by conductive wires is included, thereby achieving a significant cost reduction.

Next, a procedure for terminal-treating the electrical cable 1 and then connecting the electrical cable 1 to the shielded connector 11 will be described.

FIG. 4 is a view explaining a terminal treatment method of an electrical cable according to the present embodiment, in which FIGS. 4A to 4F each is a perspective view of a terminal portion of the electrical cable.

(Inner Conductor Exposing Step)

Figure 4A:
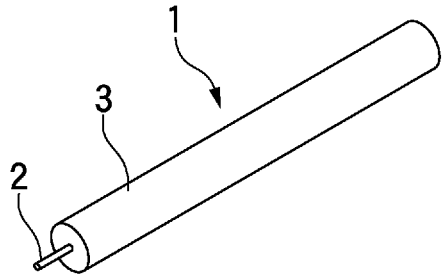
FIGS. 4A to 4F are views explaining a terminal treatment method of the electrical cable according to the embodiment, in which FIGS. 4A to 4F each is a perspective view of the terminal portion of the electrical cable.

As shown in FIG. 4A, the insulator 3 is cut and removed from the terminal portion of the electrical cable 1 before the shield layer 4 and the sheath layer 5 are mounted, thereby exposing the inner conductor 2.

(Inner Terminal Connecting Step)

Figure 4B:
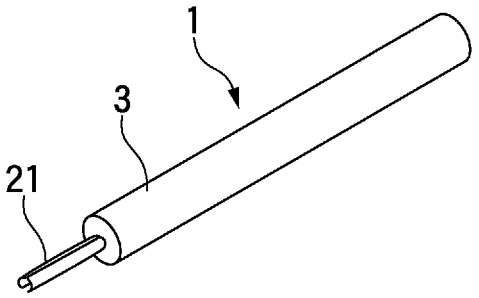

As shown in FIG. 4B, the inner terminal 21 of the shielded connector 11 is pressed against and connected to the exposed inner conductor 2.

(Outer Terminal Mounting Step)

Figure 4C:
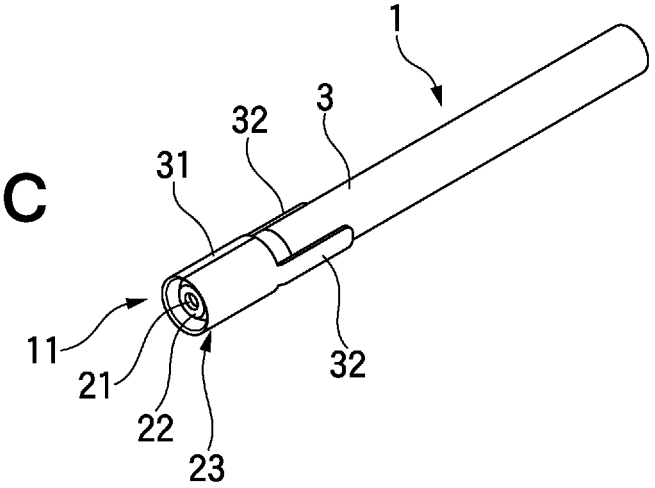

As shown in FIG. 4C, the inner terminal 21 is inserted in the insulating member 22 of the outer terminal 23, and as a result, the outer terminal 23 is mounted on the terminal portion of the electrical cable 1. By doing so, the connecting pieces 32 of the outer terminal 23 are disposed along the outer circumference of the insulator 3 of the electrical cable 1.

(Shield Layer Mounting Step)

Figure 4D:
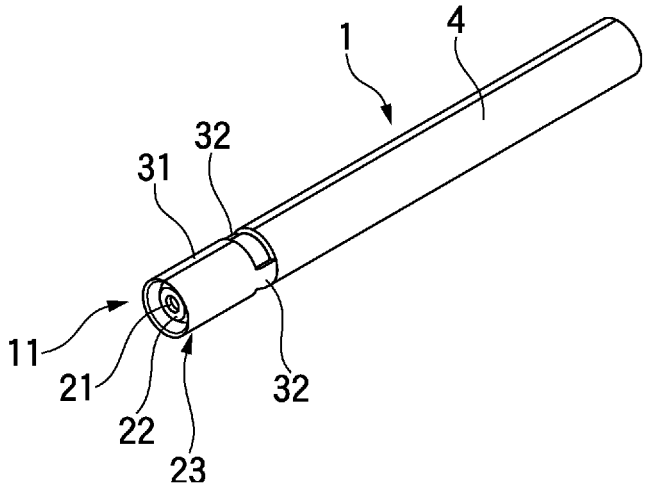

As shown in FIG. 4D, a tape-shaped metal foil forming the shield layer 4 is wound around the outer circumference of the insulator 3 of the electrical cable 1. In this time, in the terminal portion of the electrical cable 1, the shield layer 4 is mounted to cover the connecting pieces 32 of the outer terminal 23.

(Outer Terminal Connecting Step)

Figure 4E:
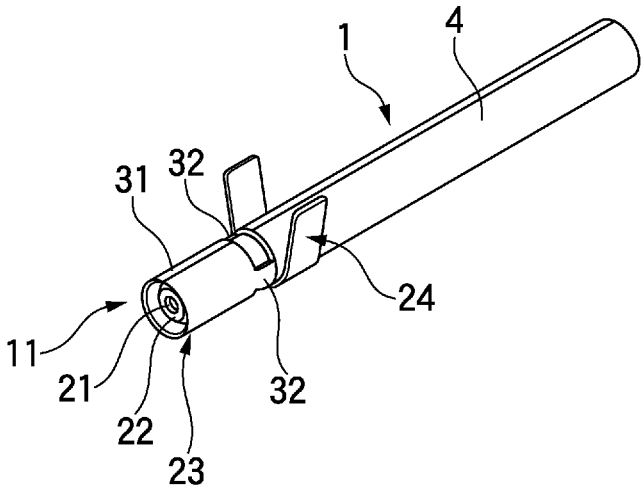
Figure 4F:
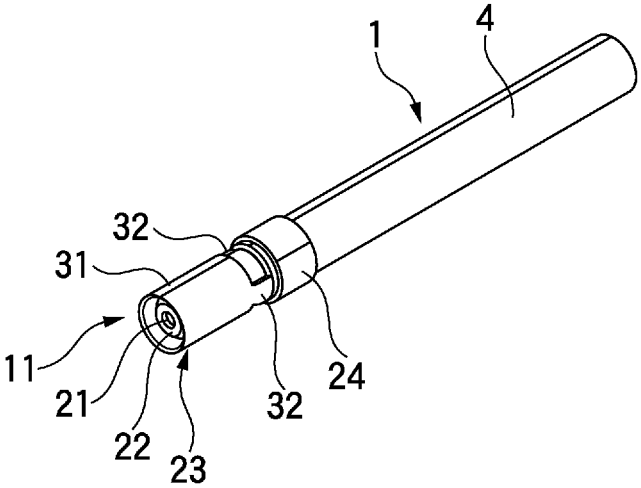
Figure 5:
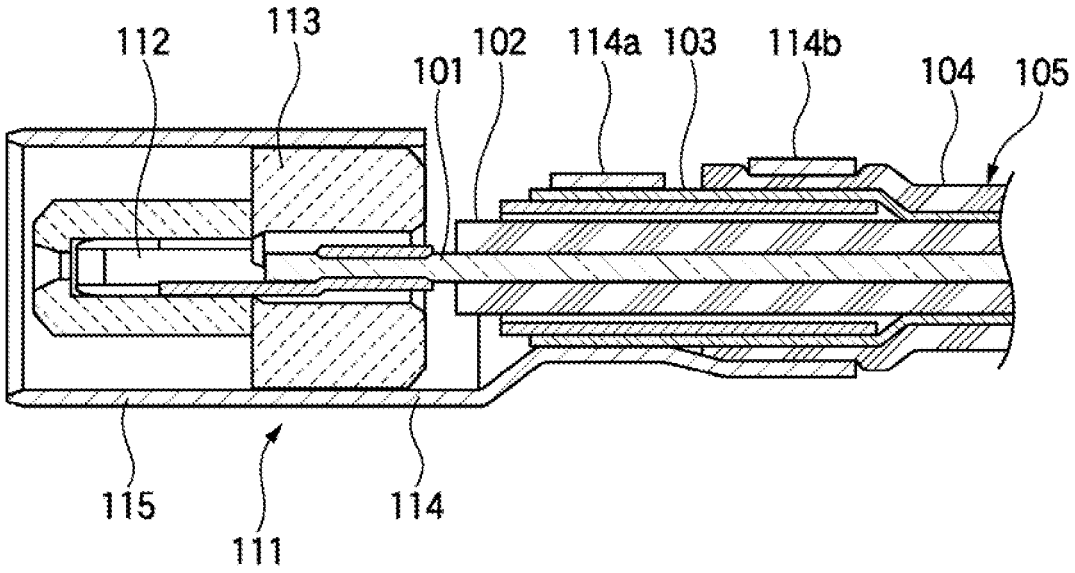
FIG. 5 is a sectional view showing a shielded electrical cable to which a shielded connector is connected.
Figure 6A:
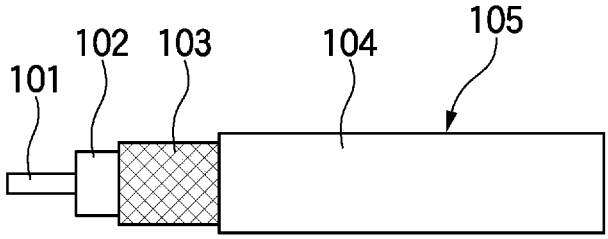
FIGS. 6A to 6D are views showing a connection procedure of the shielded connector to the shielded electrical cable, in which FIGS. 6A to 6D each is a side view of the electrical cable.
Figure 6B:
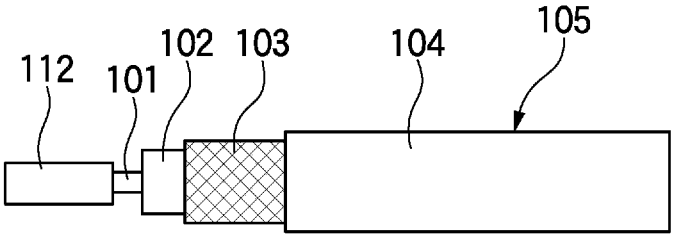
Figure 6C:
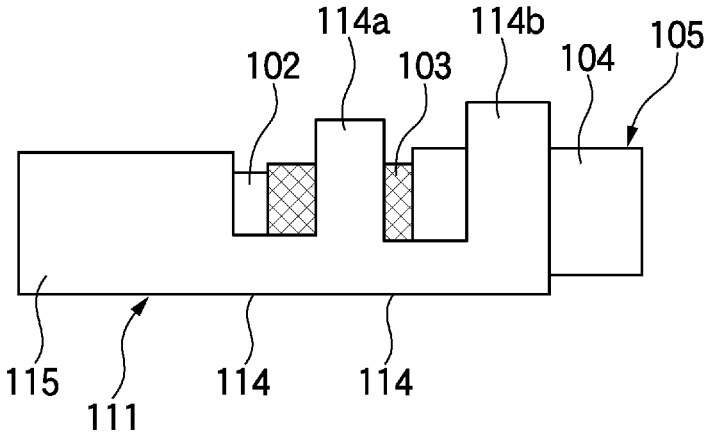
Figure 6D:
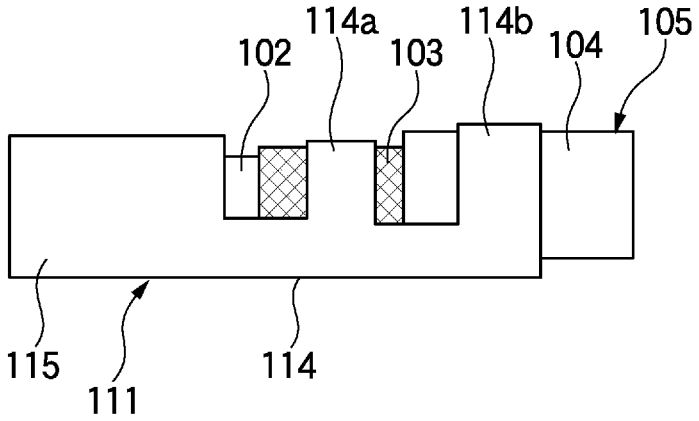

As shown in FIG. 4E, the pressing member 24 is wound around the outer circumference of the shield layer 4 in the terminal of the electrical cable 1. Then, as shown in FIG. 4F, the pressing member 24 is pressed and fixed on the outer circumference of the shield layer 4 in the terminal of the electrical cable 1 by crimping the pressing member 24. By doing so, an end portion of the shield layer 4 is connected to the connecting pieces 32 of the outer terminal 23 by means of the pressing member 24 and thus the outer terminal 23 is electrically connected to the shield layer 4.

(Sheath Layer Mounting Step)

A resin tape forming the sheath layer 5 is wound around an outer circumference of the electrical cable 1, except a position where the pressing member 24 is mounted. As a result, the shielded connector 11 is connected to the terminal of the electrical cable 1 including the shield layer 4 and the sheath layer 5 (see FIG. 1).

According to the terminal treatment method of the electrical cable of the foregoing embodiment, the connecting pieces 32 of the outer terminal 23 of the shielded connector 11 are pressed against and connected to the shield layer 4, which is made of a metal foil wound around the insulator 3, by means of the pressing member 24. Accordingly, the terminal treatment can be easily performed to have a good shield effect.

Also, the shield layer 4 is formed by winding an inexpensive metal foil without using a braid woven by conductive wires, thereby achieving a significant cost reduction.

The present invention is not limited to the foregoing embodiments, but appropriate changes, modifications or the like thereof can be made. In addition, material, shape, dimension, number, installation position and the like of each of the components of the foregoing embodiments are not limited but arbitrary as long as the present invention can be achieved.

What is claimed is:

1. A terminal structure comprising:

an electrical cable that includes an inner conductor, an insulator provided around the inner conductor, a shield layer made of a metal foil around the insulator, and a sheath layer made of a resin tape around the shield layer;

a shielded connector that is connected to a terminal of the electrical cable, wherein the shielded connector includes an inner terminal connected to the inner conductor, an insulating member covering the inner terminal, an outer terminal covering the insulating member, and a pressing member for pressing the outer terminal against the shield layer, the outer terminal includes connecting pieces disposed along an outer circumference of the insulator, and the pressing member is crimped around the shield layer so that the connecting pieces are pressed against and connected to the shield layer.

2. A shielded connector adapted to be connected to a terminal of the electrical cable including an inner conductor, an insulator around the inner conductor, a shield layer made of a metal foil around the insulator, and a sheath layer made of a resin tape around the insulator, the shielded connector comprising:

an inner terminal that is connected to the inner conductor;

an insulating member that covers the inner terminal;

an outer terminal that covers the insulating member; and a pressing member that presses the outer terminal against the shield layer, wherein the outer terminal includes connecting pieces disposed along an outer circumference of the insulator, and the pressing member is crimped around the shield layer so that the connecting pieces are pressed against and connected to the shield layer.

3. A terminal treatment method of an electrical cable for mounting a shielded connector to a terminal of an electrical cable, the electrical cable including an inner conductor, an insulator around the inner conductor, a shield layer made of a metal foil around the insulator, and a sheath layer made of a resin tape around the insulator, the shielded connector includes an inner terminal, an insulating member covering the inner terminal, and an outer terminal covering the insulating member, the terminal treatment method comprising:

exposing the inner conductor from the insulator;

connecting the inner terminal to the exposed inner conductor;

mounting the outer terminal, which has the insulating member, on the inner terminal so that connecting pieces formed on the outer terminal are disposed along an outer circumference of the insulator;

providing a shield layer by winding a metal foil around the insulator;

pressing the connecting pieces against the shield layer to be connected with each other, by crimping the pressing member onto an outer circumference of the shield layer at a position where the connecting pieces are disposed; and providing the sheath layer by winding a resin tape around the shield layer.

* * * * *